United States Patent [19]

Baljé

[11] 4,449,888

[45] May 22, 1984

[54] FREE SPOOL INDUCER PUMP

[76] Inventor: Otto E. Baljé, 3363 Charleston Way, Los Angeles, Calif. 90068

[21] Appl. No.: 371,258

[22] Filed: Apr. 23, 1982

[51] Int. Cl.[3] ..... F04D 29/44

[52] U.S. Cl. ..... 415/143; 415/90; 415/62

[58] Field of Search ..... 415/62, 64, 69, 83, 415/88, 90, 143, 149, 158, 219 A

[56] References Cited

U.S. PATENT DOCUMENTS

| | | | |
|---|---|---|---|
| 2,321,276 | 9/1939 | DeBolt | 415/143 |
| 2,344,366 | 3/1941 | Price . | |
| 2,490,066 | 12/1949 | Kollsman | 415/90 |
| 2,575,682 | 11/1951 | Price | 415/143 |
| 2,609,140 | 9/1952 | Jonker | 415/143 |
| 3,157,793 | 11/1964 | Adkins | 415/90 |
| 3,658,437 | 4/1972 | Soo | 415/219 A |
| 3,918,828 | 11/1975 | Kumm . | |
| 3,941,501 | 3/1976 | Shank | 415/219 A |

*Primary Examiner*—Charles E. Phillips
*Assistant Examiner*—Brian J. Bowman
*Attorney, Agent, or Firm*—William W. Haefliger

[57] ABSTRACT

Fluid pumping apparatus comprises (a) a housing, (b) an impeller rotatable in the housing to discharge fluid centrifugally outwardly, (c) a rotary spool having an inducer section through which intake fluid passes to the impeller, (d) a rotary diffuser associated with the rotary spool and having driving vanes located at the inlet of the diffuser and outwardly of the impeller periphery for rotatably driving the spool in response to outward flow of said discharged fluid against and between the vanes.

4 Claims, 4 Drawing Figures

FIG. 2.
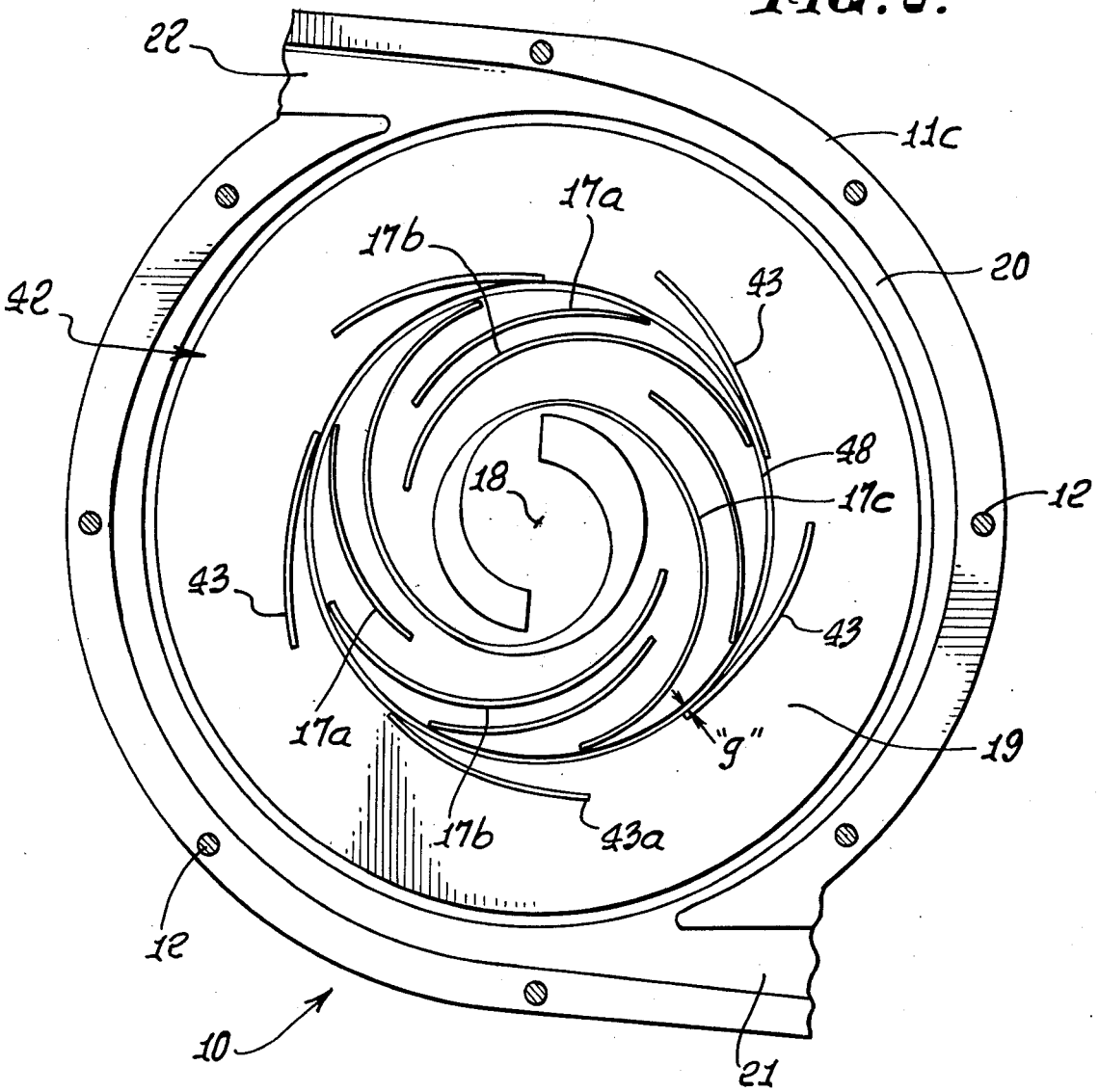
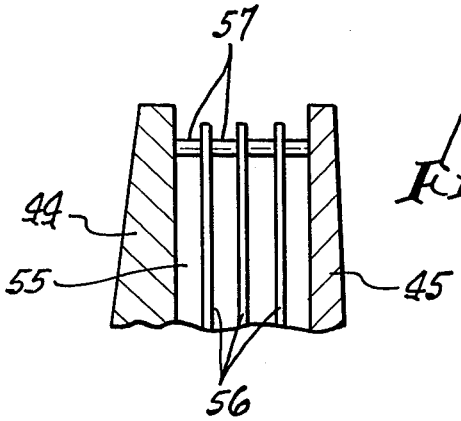
FIG. 3.

FREE SPOOL INDUCER PUMP

BACKGROUND OF THE INVENTION

This invention relates generally to method and means to increase the performance of pump systems, at low flow rates, and more particularly concerns means to increase the stable operating range of a pump to near zero flow rate, and to reduce the fluid temperature rise at low flow operation.

Pump diffusers and inducers are well known devices. In particular, a rotating diffuser rotating in the same direction as the impeller uses the shear forces inside and outside of the rotating diffuser structure to establish an equilibrium speed (anywhere between 20% to 40% of the impeller speed, depending on the diameter ratio of the rotating diffuser). In this way the shear forces at the inside of the rotating diffuser are reduced so that the efficiency of the overall arrangement (impeller and rotating diffuser) is improved, when compared to a conventional arrangement (impeller and stationary diffuser).

Additional improvements are obtained when the rotating diffuser is coupled mechanically with a rotating pre-inducer arranged in front of the centrifugal impeller. This inducer-diffuser combination, referred to as the "free spool", typically rotates at a fraction of the main impeller speed, and is particularly beneficial for pumps, since the inducer section of the free spool reduces the cavitation head requirements (NPSH) of the system, so that a higher suction specific speed design results. However, in certain cases, the equilibrium speed of the free spool, resulting from the shear forces acting on the rotating diffuser section, is either too low or too high to obtain the high suction specific speed goal.

SUMMARY OF THE INVENTION

It is a major object of the present invention to provide a pump construction overcoming the above difficulties, and enabling stable operation at very low flow rates. Another objective is to reduce back flow tendencies from the diffuser section back into the rotor, a major cause for inefficient operation and thus excessive temperature rise of the fluid at flow operation.

Basically, the free spool of the invention incorporates driving vanes at the inlet of the rotating diffuser, and in a manner such that the equilibrium speed of the free spool is governed not only by the shear forces in the vaneless portion of the diffuser, but also by the dynamic action of the driving vanes. Typically, the equilibrium speed of the free spool at part load operation is comparatively high, so that at flow operation the surface speed of the walls is larger than the peripheral speed component of the flow inside the vaneless portion downstream of the vanes of the diffuser. As a consequence, power is transferred from the free spool to the flow within the vaneless portion at low flow rates and the back flow tendencies are greatly reduced or even entirely eliminated. This increases the pressure rise at low flow rates and thus moves the potential instability point to nearly zero flow rates, i.e. increases the stable performance range to nearly zero flow. The reduction or elimination of back flow tendencies reduced the power absorption of the impeller and thus the temperature rise of the fluid. By way of contrast, without the driving vanes in the rotating diffuser, the pressure rise at low flows would be lower than the pressure rise at design flow, for constant impeller speed so that the potential instability point occurs at intermediate flow rates, i.e. the performance range is reduced. Since back flow tendencies at low flow rates are suppressed to a lesser degree, the fluid temperature rise is comparatively high.

Accordingly, a pump incorporating the invention basically comprises:

(a) a housing, (b) an impeller rotable in the housing to discharge fluid centrifugally outwardly, (c) a rotary spool having an inducer section through which intake fluid passes to the impeller, and (d) a rotary diffuser associated with the spool and driving vanes located near the inlet of the diffuser and outwardly of the impeller periphery for rotatably driving the spool in response to outward flow of the discharged fluid against and between the vanes.

Typically, the driving vanes are located outwardly of the impeller periphery within a rotating diffuser carried by the free spool; and the driving vanes extend outwardly and about the impeller axis to produce a rotary motion identical to the rotary direction of the impeller blades. Further, thin annular parallel walled rings, referred to as "Tesla" discs, may be located in the rotary diffuser outwardly and/or inwardly of the driving vanes, to increase performance.

These and other objects and advantages of the invention, as well as the details of an illustrative embodiment, will be more fully understood from the following description and drawings, in which:

DRAWING DESCRIPTION

FIG. 2 is an end view taken on lines 2—2 of FIG. 1;

FIG. 3 is an enlarged fragmentary section showing "Telsa" rings in the rotary diffuser.

DETAILED DESCRIPTION

Figures 1, 4:
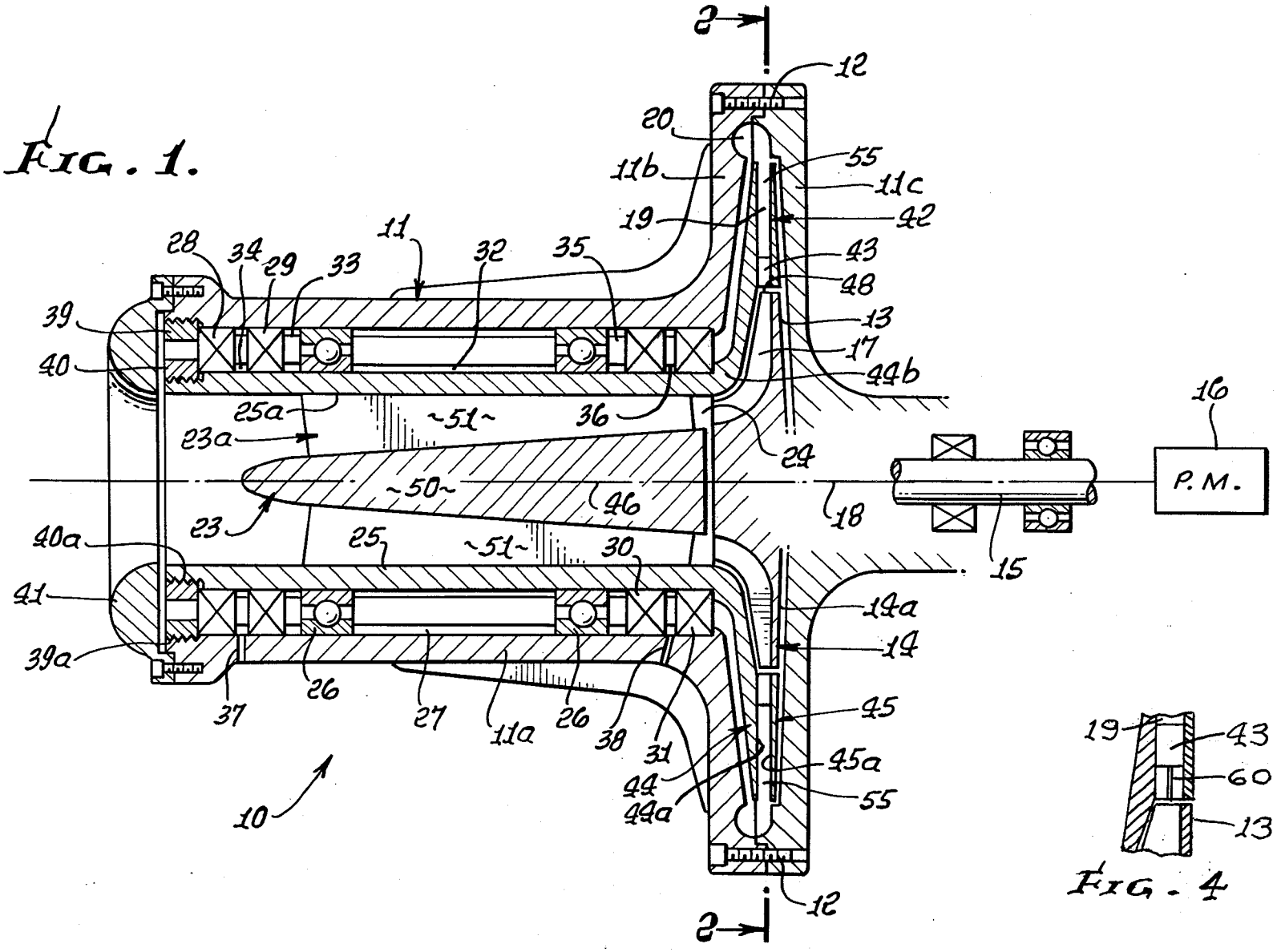
FIG. 1 is a vertical section showing details of construction.
FIG. 4 is an enlarged fragmentary view showing a modification.

In the drawings, a housing 10 includes an annular body 11 having a cylindrical section 11*a* and a first flanged section 11*b*. A body second flanged section 11*c* is attached at 12 to section 11*b* and defines therewith a radially extending space generally indicated at 13. Located within that space is an impeller 14 suitably mounted on a drive shaft 15 driven by prime mover 16. The impeller includes an end plate 14*a* and blades indicated at 17. See for example in FIG. 2 the short splitter blades 17*a*, long splitter blades 17*b*, and through blades 17*c*. All of such blades are shown to extend arcuately outwardly and clockwise relative to the impeller axis of rotation, shown at 18.

The flanged sections 11*b* and 11*c* also define annular diffuser space 19 located outwardly of annular space 13, and a scroll space 20 located outwardly of space 19. Space 20 may for example have two discharge outlet 21 and 22, for pumped i.e. pressurized fluid, as shown in FIG. 2. Fluid discharged centrifugally outwardly from the impeller passes through diffuser space 19 wherein its flow velocity is reduced and its static pressure increases.

Also provided is a rotary spool 23 having an inducer section generally indicated at 23*a* through which intake fluid passes or flows to the eye 24 of the impeller. In the example, the spool includes a cylindrical body 25 supported for free rotation within the housing, as by axially spaced bearings 26. Axially spaced seals 29 and 30 confine lubricant; and seals 28 and 31 prevent fluid from contaminating lubricant. See also spacers 32–36. Seal drains appear at 37 and 38. Annular retainers 39 and 40 may be thread connected to the housing and spool as at 39*a* and 40*a*, to axially retain the seal and bearing assembly in position. Intake flow guide 41 is connected to housing body 11, as shown.

In accordance with the invention, a rotary diffuser, as at 42, is associated with the spool, and driving vanes 43 are located at the inlet to the diffuser and outwardly of the impeller periphery, for rotatably driving the spool in response to outward flow of impeller discharged fluid against and between the vanes 43. As shown, the vanes 43 are carried by the spool, as between radially extending plates 44 and 45 in diffuser passage 19. Note that the plates have generally parallel inner wallls 44*a* and 45*a* extending normal to spool axis 46 (co-axial with axis 18), and that the vanes extend between those walls outwardly of the impeller periphery 48. Also, FIG. 2 shows vanes 43 extending outwardly and counterclockwise relative to axis 18 (and axis 46). Note the slight gap "g" between the impeller periphery and the innermost edges of vanes 43. Spool plates 44 and 45 also extend radially outwardly into proximity with scroll space 20; plate 45 extends radially inwardly into proximity to the periphery of impeller plate 14*a;* and plate 44 extends inwardly in confining relation with the edges of the impeller blades 17, and joins the spool cylindrical body in region 44*b*.

A central cone 50 associated with the spool is in axial alignment with the impeller, and inducer blades 51 extend between the cone and the cylindrical body 25. For two phase flows (high V/L pumps), the cross sectional area between the cone and the bore 25*a* of the body 25 decreases in the direction toward the impeller, whereby the intake flow velocity increases in response to rotation of the spool, driven by the vanes 43 against which fluid is discharged by the impeller. For single phase flow, the area would be substantially constant.

Outwardly of drive vane outer edges 43*a* the space 55 between the plate 44 and 45 is free of such vanes, the radial extent of space 55 being typically in excess of the radial extents of the vanes 43. Thin annular "Tesla" rings 56 may be employed in space 55, such rings extending in planes normal to axis 18. They may be attached to vanes 43, and attached to plate 44 and 45, as via narrow rods 57. See FIG. 3 in this regard.

In operation, the driving vanes 43 increase the driving forces for the free spool, increasing its equilibrium speed to a desired level. Accordingly, the effective exit angle, when measured against peripheral direction of the driving vanes, is typically larger than the effective angle, again measured against peripheral direction, at vane inlet, for a parallel walled annular diffuser. The described location of the driving vanes becomes crucial, when stable performance at extremely low flow rates is desired. In this regard, the natural flow path in the vaneless annular diffuser formed by parallel walls, is a logarithmic spiral and thus at low flow rates the flow path length becomes rather larger. Hence high frictional losses are incurred at low flow rates, so that the pressure rise of the pump system obtained at low flow rates is smaller than the pressure rise obtained at design point, which puts the part load operation into the potentially unstable operating branch of the pump characteristics. By arranging the driving vanes near the rotating diffuser inlet as described herein, the angle of the flow vector discharged from the vaned section is increased so that the flow path length is shortened; and hence, the pressure rise at low flow rates is increased.

Another benefit of this arrangement at low flow consists in that with proper design of the turbine cascade, the rotative speed of the free spool can be tailored to have the wall speed of the rotating diffuser behind the driving vanes larger than the peripheral component of the flow vector. Hence, energy is transferred from the walls of the rotating diffuser into the flow whereby the pressure rise of the pump arrangement, when operated at low flow rates, is increased even further, so that the pressure rise at this operational condition becomes larger than the pressure rise at design point operation. Thus, by designing the driving vanes and geometry of the rotating diffuser section, particularly its diameter ratio, judiciously, a performance characteristic can be obtained such that the pressure rise of the pump decreases steadily from part load to design point operation, so that the pump performance in this regime becomes stable. Calculations have shown that the pump will still operate stably at 2% of the design flow rate with such an arrangement, yielding a turn-down ratio of 50 to 1.

The capability of transferring power from the walls of the rotating diffuser into the flow via shear forces can be enhanced when parallel walled rings are provided in the downstream section of the vaneless portion of the rotating diffuser as described. Here again the spacing of the rings is critical. The optimum spacing being determined by boundary layer thickness considerations which show that the desired spacing is no less than twice the boundary layer thickness and no more than five times the boundary layer thickness, providing that disc thickness is comparatively small.

To reduce the backflow tendency between diffuser inlet and impeller exit which is most pronounced at low flow rates, the wall speed of the rotating diffuser at its inlet should be high at low flow rates. Thus the means employed to obtain a large turn down ratio will also be beneficial to reduce the backflow tendency thereby reducing power absorbtion of the impeller and thus reducing the temperature rise of the fluid. To enhance this effect the position of "Tesla" rings in front of the driving vanes will in some applications be desirable.

In the above, guiding principles for the free spool design are to design the driving vanes in the rotating diffuser in such a manner that, at the design point of operation, the dynamic effect is almost negligible (nearly neutral vanes) and not only to select a free spool speed which gives maximum overall efficiency, but to have the free spool speed at part load operation in a range where energy is transferred from the inside of the rotating diffuser to the fluid to obtain the desired pressure rise. These objectives are realized, for example, in the structure shown in FIGS. 1 and 2.

In FIG. 4, a "Tesla" ring or disc 60 is alternatively located immediately outwardly of the periphery of the impeller. It is attached to the driving vanes 43 located outwardly of the disc 60.

I claim:

1. In fluid pumping apparatus, the combination comprising (a) a housing, (b) an impeller rotable in the housing about an axis to discharge fluid centrifugally outwardly, (c) a rotary spool having an inducer section through which intake fluid passes to the impeller, (d) a rotary radial diffuser connected with the rotary spool and having driving vanes located at the inlet of the diffuser and outwardly of the impeller periphery for rotatably driving the spool in response to outward flow of said discharged fluid against and between the vanes, (e) said driving vanes having inner ends substantially adjacent the impeller periphery, and outwardly thereof, (f) said impeller having blades which spiral radially and circumferentially outwardly in one rotary direction about the impeller axis, said driving vanes spiralling radially and circumferentially outwardly in the opposite rotary direction about said axis and from said inner ends, and entirely outwardly of the impeller, (g) said spool at all times being rotatable free of connection to the impeller, (h) there being Tesla ring means on the spool and located radially of the driving vanes.

2. The combination of claim 1 wherein said Tesla ring means comprises at least one annular Tesla ring associated with the spool and located in said diffuser outwardly of said driving vanes.

3. The combination of claim 1 wherein said Tesla ring means comprises multiple Tesla rings in a flow zone radially outwardly of said driving vanes, said rings extending in planes substantially normal to an axis of rotation defined by the impeller.

4. The combination of claim 1 wherein said inducer section includes inducer blades located axially of the impeller, and bearing means carried by the housing and supporting the spool for rotation.

* * * * *